US006106104A

United States Patent [19]

Fujita et al.

[11] Patent Number: 6,106,104

[45] Date of Patent: Aug. 22, 2000

[54] IMAGE FORMING APPARATUS

[75] Inventors: Hirokazu Fujita, Nara; Daisaku Imaizumi, Yamatokoriyama, both of Japan

[73] Assignee: Sharp Kabushiki Kaisha, Osaka, Japan

[21] Appl. No.: 09/042,408

[22] Filed: Mar. 13, 1998

[30] Foreign Application Priority Data

Mar. 19, 1997 [JP] Japan ..... 9-066014

[51] Int. Cl.[7] ..... B41J 2/06

[52] U.S. Cl. ..... 347/55

[58] Field of Search ..... 347/55

[56] References Cited

U.S. PATENT DOCUMENTS

| | | | |
|---|---|---|---|
| 5,036,341 | 7/1991 | Larsson | 347/55 |
| 5,202,704 | 4/1993 | Iwao | 347/55 |
| 5,293,181 | 3/1994 | Iwao et al. | 347/55 |
| 5,357,274 | 10/1994 | Kitamura | 347/55 |
| 5,359,361 | 10/1994 | Iwao et al. | 347/55 |

FOREIGN PATENT DOCUMENTS 6-71928 3/1994 Japan .

8-15980 1/1996 Japan .

*Primary Examiner*—Fred L. Braun

*Attorney, Agent, or Firm*—Dike, Bronstein, Roberts & Cushman, LLP; David G. Conlin; William J. Daley, Jr.

[57] ABSTRACT

An image forming apparatus having a carrier for carrying toner, a back electrode disposed with a space between the carrier and back electrode, a control electrode disposed between the carrier and back electrode, for forming an electric field capable of causing toner on the carrier to fly toward the back electrode from the carrier and for forming an image by causing selectively the toner to fly and adhere to a recording medium according to an image signal, and a voltage applying section for applying an oscillating voltage to the control electrode. In order to prevent resonance of the control electrode, the oscillating voltage to be applied to the control electrode is set so that minimum natural numbers m and n satisfying that m times a frequency of the oscillating voltage to be applied to the control electrode is equal to n times the characteristic vibration frequency of the control electrode are more than 10. With this structure, it is possible to form an image with improved image quality quietly by preventing generation of noise due to vibrations of the control electrode, and suppressing the displacement of the control electrode.

9 Claims, 15 Drawing Sheets

IMAGE FORMING APPARATUS

FIELD OF THE INVENTION

The present invention relates to an image forming apparatus for use in OA (office automation) devices such as printers, copying machines, and facsimile machines, for forming a visible image on a recording medium by using an electric field according to electric image signals. More specifically, the present invention relates to means for preventing vibrations of a control electrode that is disposed between a toner carrier and a back electrode in the image forming apparatus so as to control flying of toner.

BACKGROUND OF THE INVENTION

As a method for forming a visible image on a recording medium according to electric image signals, a method called "xerography" has been generally known. In this method, an electrostatic pattern (or electrostatic latent image) is formed on an image carrier having a photosensitive layer with electro-optical properties by optical writing means. After developing the electrostatic pattern to form a toner image by causing toner (developer particles) to adhere to the electrostatic pattern, the toner image is transferred onto the recording medium. Thus, the image signals are developed as a visible image on the recording medium.

In this method, first, an image signal is converted into an optical signal using a light emitting device (or light emitting element) such as a laser and LED (light emitting diode). Then, the optical signal is applied to the photosensitive layer which has been uniformly charged beforehand, thereby forming an electrostatic pattern according to the light intensity. Next, a toner image is formed on the photosensitive layer by bringing charged toner into contact with the electrostatic pattern or causing the toner to fly to the electrostatic pattern (this process is called the development step). Subsequently, the toner on the image carrier is caused to adhere to the recording medium by electric adhesion and/or pressure (this process is called the transfer step). Thereafter, the toner is fixed to the recording medium by applying pressure and/or heat to the recording medium.

Another known method uses a charged particle generator, a charged particle flow control grid, and a dielectric drum as the image carrier. In this method, first, a charged image corresponding to image signals is formed on the dielectric drum by controlling the flow of charged particles according to the image signals. Next, a toner image is formed on the image carrier by developing the charged image using toner. Subsequently, the toner on the image carrier is caused to adhere to a recording medium by electric adhesion and/or pressure. Thereafter, the toner is fixed onto the recording medium by applying pressure and/or heat to the recording medium.

In the above-mentioned conventional methods, the image signals are formed as an electrostatic latent image temporarily on the image carrier, and then the toner image is formed on the image carrier by developing the electrostatic latent image using the toner. It is therefore necessary to use the image carrier having a special structure, and writing means for writing the electrostatic latent image. Additionally, when a repeat use of the image carrier is required, it is necessary to provide means for erasing a previously written electrostatic latent image as well as the writing means. Moreover, since the toner image formed temporarily on the image carrier is caused to adhere to the recording medium, the processing steps tends to be complicated, and problems arise in terms of the stability and miniaturization of the apparatus.

In order to solve these problems, for example, U.S. Pat. No. 5,036,341 (corresponding to Japanese publication of international patent application No. 50321/1989 (Tokuhyohei 1-50321)) proposes a direct image forming method. In this method, a toner image is formed on the recording medium by causing charged toner (developer particles) to fly to the recording medium directly and selectively using a charged particle flow control grid (control electrode) that is controlled according to image signals. Thereafter, the toner image is fixed to the recording medium by applying pressure and/or heat to the recording medium. In this method, since the above-mentioned image carrier is not used, the processing steps are simplified, thereby achieving a compact apparatus with improved stability.

However, in the device of the above-mentioned patent, when a signal voltage corresponding to an image to be formed is intermittently applied to the control electrode in forming the toner image on the recording medium, the electrostatic force acting in the vicinity of the control electrode varies. As a result, the control electrode vibrates. When a standing wave is generated by resonance of the vibration of the control electrode and another vibration produced in the image forming apparatus, the standing wave produces noise, preventing a quiet apparatus. In addition, the resonance displaces the control electrode, and the position to which the toner flies deviates from an area where the image is to be formed. Thus, there is a possibility that the image quality is lowered.

In order to prevent noise from being generated during image formation, Japanese publication of unexamined patent application No. 15980/1996 (Tokukaihei 8-15980) discloses a method of suppressing vibrations by offsetting a force produced by a voltage applied to the electrode by the application of a counter electric field. However, in the direct image forming method, since the flying of toner is controlled by an electric field in the vicinity of the control electrode, it is theoretically impossible to apply excessive strength of counter electric field to the vicinity of the control electrode. Therefore, this method cannot be used as means for preventing noise in the direct image forming method.

Furthermore, Japanese publication of unexamined patent application No. 71928/1994 (Tokukaihei 6-71928) discloses a recording device in which the displacement due to vibrations is decreased by placing an opening of an aperture electrode at a position where the value of vibration becomes minimum. This arrangement can improve the accuracy of the position of the control electrode. However, in this device, although the position of the opening is fixed, there is a possibility that the position showing the minimum vibration varies with a change in environment such as ambient temperature, and the type of the device. Hence, this recording device is instable. Additionally, in this patent document, any method for damping possible vibrations of an arbitrary frequency is not considered. Namely, this patent document does not propose a fundamental method for eliminating vibrations.

SUMMARY OF THE INVENTION

It is an object of the present invention to provide an image forming apparatus capable of forming quietly an image with improved quality by preventing or damping resonance generated during image formation and preventing displacement of a control electrode, using a direct image forming method.

In order to achieve the object, an image forming apparatus of the present invention includes:

a carrier for carrying toner;

a back electrode disposed with a space between the back electrode and the carrier;

a control electrode, disposed between the carrier and back electrode, for forming an electric field capable of causing toner on the carrier to fly toward the back electrode from the carrier, and forming an image by causing selectively the toner to fly and adhere to a recording medium passing between the control electrode and back electrode, according to an image signal; and a voltage applying section for applying an oscillating voltage to the control electrode, the frequency of the oscillating voltage to be applied to the control electrode being set so as to prevent resonance of the control electrode.

More specifically, it is preferred to set the frequency of an oscillating voltage to be applied to the control electrode for forming one dot in forming an image, or the frequency of an oscillating voltage to be applied to the control electrode for forming one line by a plurality of dots in forming an image, so that minimum natural numbers m and n satisfying that m times the frequency of the oscillating voltage is equal to n times the characteristic vibration frequency of the control electrode are more than 10. By satisfying these conditions, it is possible to surely prevent resonance of the control electrode.

In other words, denoting the frequency of the oscillating voltage to be applied to the control electrode for forming one line by A and the characteristic vibration frequency of the control electrode by B, the least common multiple of A and B >10A, and >10B.

In order to achieve the above object, another image forming apparatus of the present invention includes:

the image carrier with the above-mentioned structure;

the back electrode with the above-mentioned structure;

the control electrode with the above-mentioned structure; and a movable member drive mechanism for vibrating the control electrode, such as a motor for driving a movable member, and is characterized in that the frequency of a vibration produced by a driving operation of the movable member drive mechanism is set so as to prevent resonance of the control electrode.

It is preferred that the frequency of the vibration produced by the driving operation of the movable member drive mechanism is set so that minimum natural numbers m and n satisfying that m times the frequency of the vibration produced by the driving operation of the movable member drive mechanism is equal to n times the characteristic vibration frequency of the control electrode are more than 10. By satisfying these conditions, it is possible to surely prevent resonance of the control electrode.

In order to achieve the above object, still another image forming apparatus of the present invention includes:

a carrier for carrying toner;

a back electrode disposed with a space between the back electrode and the carrier;

a control electrode, disposed between the carrier and back electrode, for forming an electric field capable of causing toner on the carrier to fly toward the back electrode from the carrier, and forming an image by causing selectively the toner to fly and adhere to a recording medium passing between the control electrode and back electrode, according to an image signal, the control electrode including a head section to which a voltage is applied according to the image signal, and a support section for supporting the head section in a main body of the image forming apparatus; and a boundary surface between the head section and support section, and is characterized in that the boundary surface reflects an elastic wave incident on the boundary surface in a direction different from an incident direction so as to prevent generation of a standing wave in the control electrode.

When the incident direction of the elastic wave and the reflecting direction coincide with each other, a standing wave is easily produced. Therefore, by forming a plurality of planes at the boundary between the head section and support section so that extended planes of the plurality of planes intersect each other, it is possible to arrange the reflecting direction of the elastic wave from the boundary surface to differ from the incident direction. With this arrangement, the elastic wave incident on the boundary surface is diffused, thereby preventing the generation of standing waves in the control electrode.

In order to achieve the above object, yet another image forming apparatus of the present invention includes:

a carrier for carrying toner;

a back electrode disposed with a space between the back electrode and the carrier;

a control electrode, disposed between the carrier and back electrode, for forming an electric field capable of causing toner on the carrier to fly toward the back electrode from the carrier, and forming an image by causing selectively the toner to fly and adhere to a recording medium passing between the control electrode and back electrode, according to an image signal; and a vibration changing member, disposed on the control electrode, for changing a vibration of the control electrode so as to prevent generation of a standing wave in the control electrode. With this structure, the elastic wave travelling to the control electrode is scattered, thereby preventing generation of a standing wave.

As the vibration changing member for changing a vibration of the control electrode including the head section to which a voltage is applied according to the image signal and the support section for supporting the head section in the main body of the image forming apparatus, it is possible to use a vibration diffuser formed on the head section to diffuse the vibration of the head section, a vibration absorbing diffuser with Young's modulus different from Young's modulus of the head section, or a vibration absorbing diffuser that is formed by partially varying the thickness of the head section to protrude from the head section.

With the use of such a vibration changing member, when the elastic wave on the control electrode reaches the vibration changing member, it is diffused or scattered in a plurality of directions, or a part of the elastic wave is reflected at the boundary between the head section and vibration changing member, thereby damping the vibration. This structure diffuses the elastic wave, thereby suppressing the generation of standing waves.

In order to achieve the above object, another image forming apparatus of the present invention includes:

a carrier for carrying toner;

a back electrode disposed with a space between the back electrode and the carrier;

a control electrode, disposed between the carrier and back electrode, for forming an electric field capable of causing toner on the carrier to fly toward the back electrode from the carrier, and forming an image by causing selectively the toner to fly and adhere to a recording medium passing between the control electrode and back electrode, according to an image signal, the control electrode having a head section to which a voltage is applied according to the image signal, and a support section for supporting the head section in the main body of the image forming apparatus; and a damping member, disposed in a boundary section between the head section and support section, for damping a vibration of the control electrode so as to prevent generation of a standing wave in the control electrode.

With this structure, when the elastic wave on the control electrode reaches the damping member, the reflection of a part of the elastic wave and transmission of a part of the elastic wave are repeated. Thus, the elastic wave is damped.

As the damping member, it is possible to use a damper made of an elastic material or a small spring. As the damper, it is preferred to use a damper with Young's modulus varying from the support section toward the head section, or a damper with thickness varying from the support section toward the head section.

For a fuller understanding of the nature and advantages of the invention, reference should be made to the ensuing detailed description taken in conjunction with the accompanying drawings.

DESCRIPTION OF THE PREFERRED EMBODIMENT

Figure 1A:
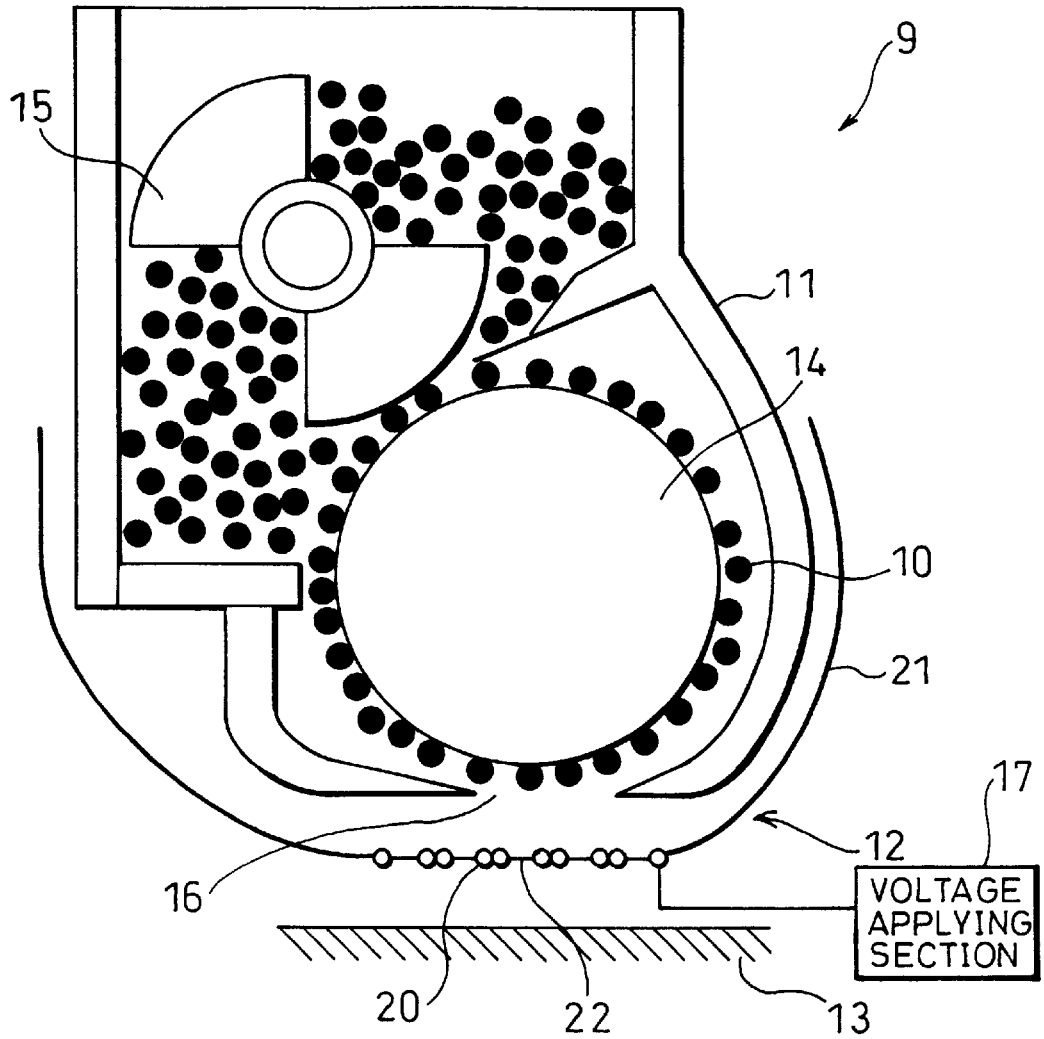
FIGS. 1(*a*) and 1(*b*) show a recording head of an image forming apparatus of the present invention, and more specifically FIG. 1(*a*) is a cross section showing the overall structure of the recording head and FIG. 1(*b*) is an enlarged cross section showing in detail a control electrode and vicinity of the recording head.
Figure 1B:
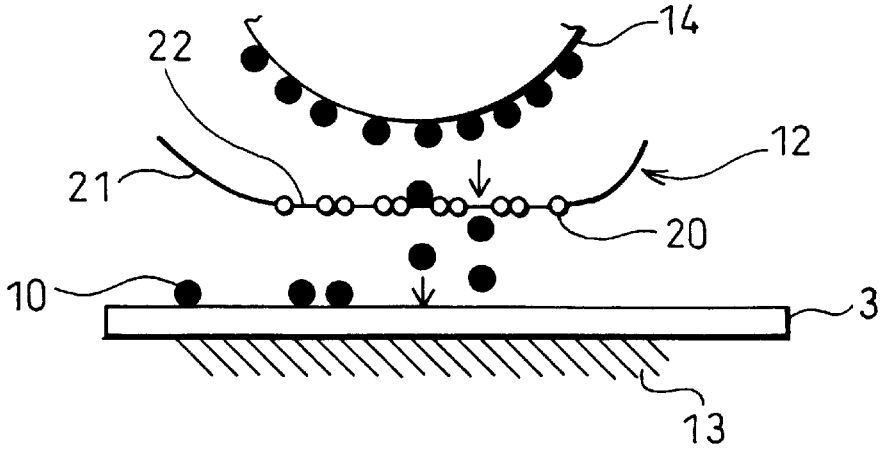

The following description will explain an embodiment of the present invention with reference to FIGS. 1(*a*) to 21.

Figure 2:
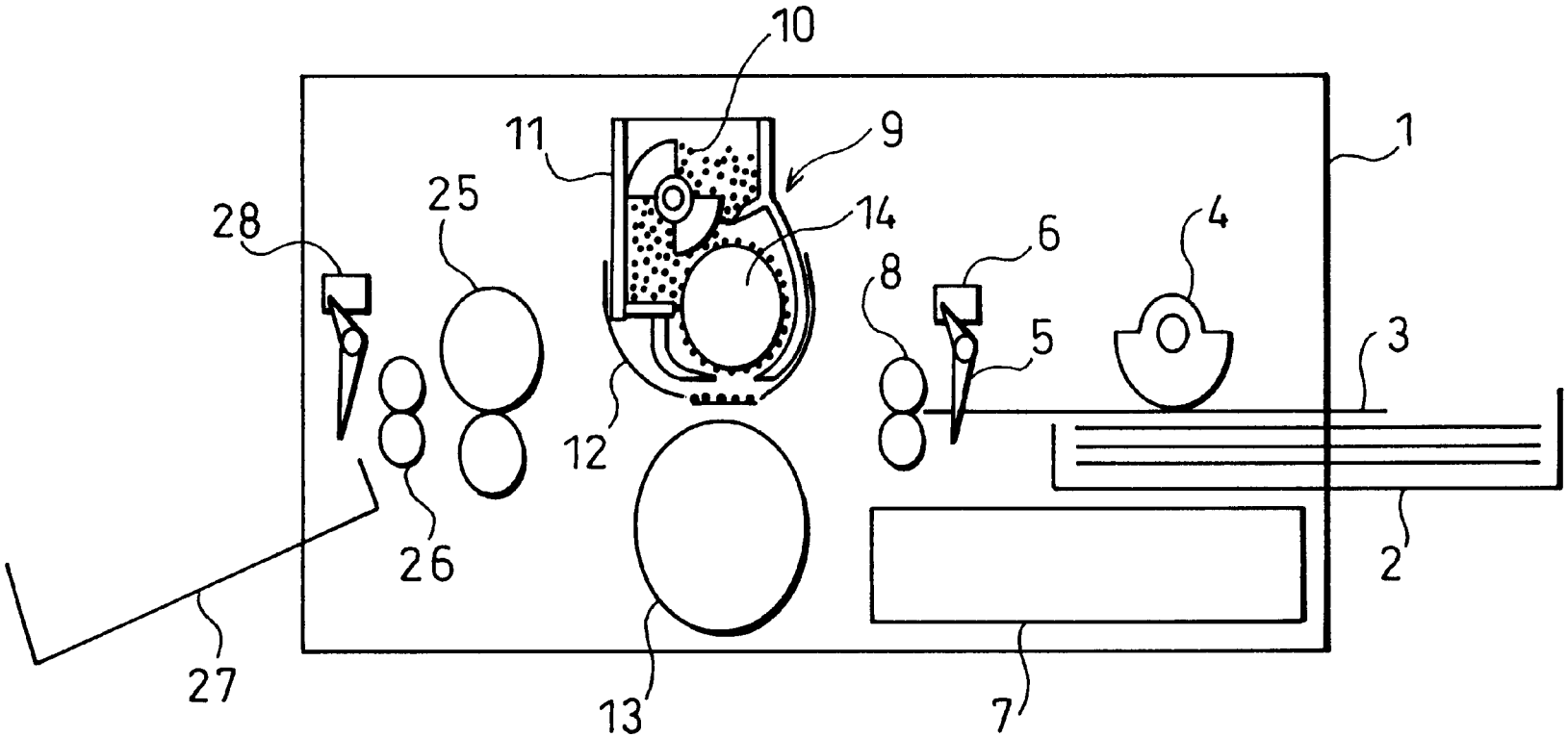
FIG. 2 is a schematic cross section showing the structure of the image forming apparatus.

An image forming apparatus of the present invention has a structure shown schematically in FIG. 2. In the image forming apparatus, a feed roller 4 is rotated by the operation of a motor (not shown) mounted in the main body 1 of the image forming apparatus, according to an image formation start signal from a host computer (not shown). As a result, a sheet of recording medium 3, for example, paper, stored in a recording medium storage section 2, such as a cassette and tray, is fed from the recording medium storage section 2 into the main body 1 by the feed roller 4. When the recording medium 3 is fed into the main body 1, it pushes up a feed actuator 5. Consequently, a feed sensor 6 is activated, and sends to a control unit 7 a detection signal for detecting correct feeding of the recording medium 3. The function of the control unit 7 is to control the mechanism sections of the image forming apparatus. The recording medium 3 stops temporarily at register rollers 8 positioned in a still state on a downstream side of the feed roller 4.

Upon reception of the detection signal indicating that the recording medium 3 is correctly fed from the feed sensor 6, the control unit 7 starts generating an image signal according to the image formation start signal from the host computer. Then, the control unit 7 converts the image signal into an electric signal to be supplied to a recording head 9. When a certain amount of image signals are converted into electric signals (the amount varies depending on the structure, etc. of the image forming apparatus), the control unit 7 activates a motor (not shown) for driving the register rollers 8 so as to transport the recording medium 3 to the position of the recording head 9. When the recording medium 3 is transported to the position of the recording head 9, the control unit 7 supplies the electric signals corresponding to the image signals to the recording head 9.

As illustrated in FIGS. 1(*a*) and 1(*b*), the recording head 9 includes a developer tank 11 for storing charged toner 10 as charged particles, a control electrode 12 for controlling flying of the toner 10, and a cylindrical back electrode 13 for stabilizing an electric field in the vicinity of the control electrode 12 and the flying direction of the toner 10. The back electrode 13 is disposed to face the developer tank 11 with the control electrode 12 therebetween.

In the developer tank 11, a cylindrical carrier 14 for carrying the charged toner 10 by electrostatic force or electromagnetic force is rotatably mounted, and an agitator 15 for agitating the toner 10 is disposed rotatably above the carrier 14. The agitator 15 agitates the toner 10 to charge the toner 10 by friction, and supplies the toner 10 to the carrier 14. The carrier 14 is formed by a rotatable nonmagnetic sleeve, and a magnetic body mounted in the sleeve. In the carrier 14, the thickness of a layer of the toner 10 on the surface of the sleeve is regulated, and the toner 10 is transported to an aperture position 16 facing the control electrode 12 while being charged by friction with the rotation of the carrier 14.

The control electrode 12 is formed by a head section 20 through which the toner passes 10, and a support section 21 for supporting the head section 20. The head section 20 is disposed to face the aperture position 16 with a predetermined distance from the toner layer so that the head section 20 does not come into contact with the toner layer on the carrier 14. The support section 21 is attached to the developer tank 11. The carrier 14 may be made in a belt form. The back electrode 13 may be made in a plate form or belt form.

In the recording head 9, a voltage is applied to the control electrode 12 from a voltage applying section (voltage applying means) 17 according to the electric signals from the control unit 7, thereby controlling the electric field in the vicinity of the control electrode 12. Consequently, an electric field for allowing the toner 10 to fly from the carrier 14 toward the back electrode 13 is produced in the vicinity of the control electrode 12.

When the recording medium 3 is transported to the position of the recording head 9, the toner 10 selectively flies from the carrier toward the back electrode 13 through the aperture 22 of the control electrode 12 because of the influence of the electric field in the vicinity of the control electrode 12 which has varied according to the electric signals from the control unit 7. As a result, the toner 10 adheres to the recording medium 3 being transported between the back electrode 13 and control electrode 12. At this time, the control unit 7 supplies the electric signals to the control electrode 12 in synchronous with the transport of the recording medium 3, thereby forming an image on the recording medium 3 by the toner 10.

The recording medium 3 having the image formed by the toner 10 thereon is transported to a fixing section 25. In the fixing section 25, the toner 10 on the recording medium 3 is fused by applying pressure and/or heat to the recording medium 3. As a result, the toner 10 is fixed to the recording medium 3.

The recording medium 3 which has passed through the fixing section 25 is fed to a tray 27 by feed rollers 26. At this time, a feed sensor 28 detects that the recording medium 3 has been correctly fed, and sends a detection signal indicating the detection of the feeding of the recording medium 3 to the control unit 7. Then, the control unit 7 judges from the detection signal that the image forming operation has been correctly completed.

Next, the following description will explain the flying of the toner 10. In general, in the study of electromagnetism it is known that, when charged particles are placed on the boundary surface between air (or vacuum) and a substance, the force of electrostatic attraction is produced between the boundary surface of the substance and charged particles. Therefore, the toner 10 is carried on the surface of the carrier 14 by the electrostatic force. At this time, if an electric field strength exceeding the electromagnetic attraction force between the toner 10 and carrier 14 is applied to the surface of the carrier 14, the toner 10 separates from the carrier 14, is accelerated by the force of the electric field, and moves in a predetermined direction. The electric field strength equivalent of the electromagnetic attraction force between the toner 10 and carrier 14 is called the "toner flying starting electric field strength Eth", and a value 1 kV/mm was obtained in an experimental system.

Figure 3A:
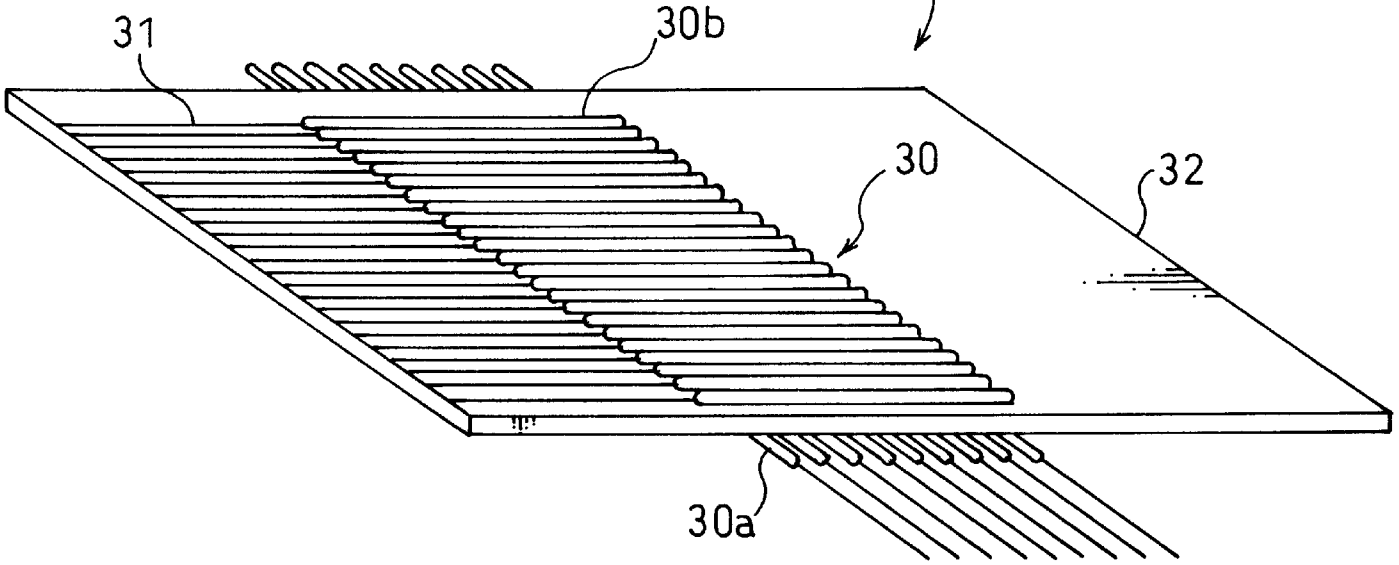
FIGS. 3(*a*) and 3(*b*) show an example of a head section of the control electrode, FIG. 3(*a*) being a perspective view and FIG. 3(*b*) being a cross section.
Figure 3B:
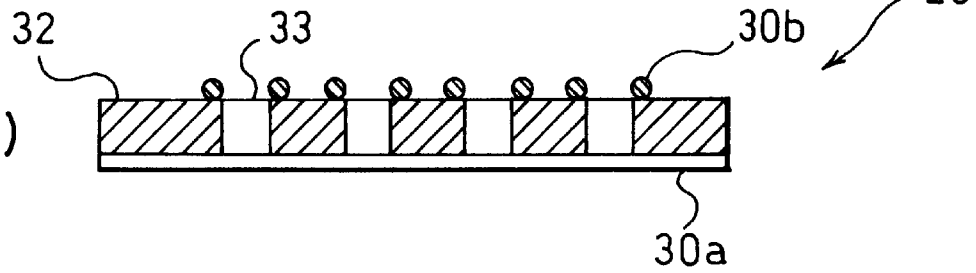

As illustrated in FIGS. 3(*a*) and 3(*b*), the head section 20 of the control electrode 12 includes charged particle flow control grids 30, control electrode leaders 31, and an insulator 32 made of a polymer film, for example, polyimide, for supporting the charged particle flow control grids 30 and control electrode leaders 31. The charged particle flow control grids 30 and control electrode leaders 31 are separated and independent from each other. The edges of the insulator 32 are attached to the support section 21 thicker than the insulator 32 or inserted into the groove of the support sections 21 so that the insulator 32 is fixed.

Figure 4:
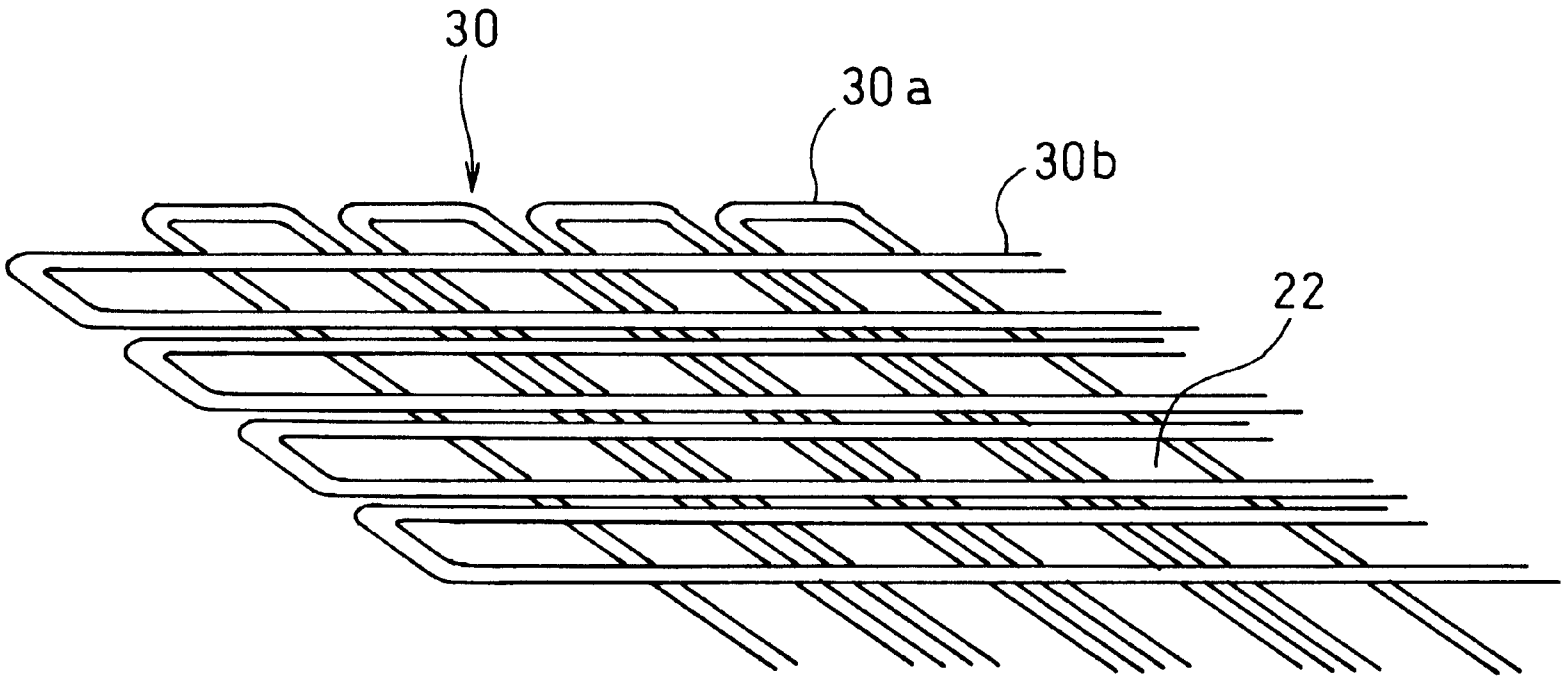
FIG. 4 is a perspective view showing a charged particle flow control grid of the head section shown in FIGS. 3(*a*) and 3(*b*).

As illustrated in FIG. 4, the charged particle flow control grid 30 has a mesh structure formed by wires such as copper wires, and is connected to the voltage applying section 17 shown in FIG. 1. The charged particle flow grid 30 is formed by X-direction electrodes 30*a* and Y-direction electrodes 30*b* which are arranged in the form of a grid by plating the front and back faces of the insulator 32 with a metal or pasting a metal foil to the faces of the insulator 32. Formed in the areas of the insulator 32 enclosed by the Y-direction electrodes 30*b* are slots 33 arranged in a line. A plurality of rectangular openings 22 of a size allowing the passage of the toner 10 are formed by placing the X-direction electrodes 30*a* to intersect the slots 33.

By producing the toner flying starting electric field strength Eth on the surface of the carrier 14, the toner 10 is allowed to fly to the back electrode 13. At this time, electric field patterns corresponding to the image signals are produced on the surface of the carrier 14 by the potential differences among the voltage applied to the X-direction electrodes 30*a* and Y-direction electrodes 30*b* of the charged particle flow control grid 30 by the voltage applying section 17, the electric potential of the carrier 14, and the electric potential of the back electrode 13. Consequently, the toner 10 flies toward the back electrode 13 selectively according to the image signals.

Figure 5A:
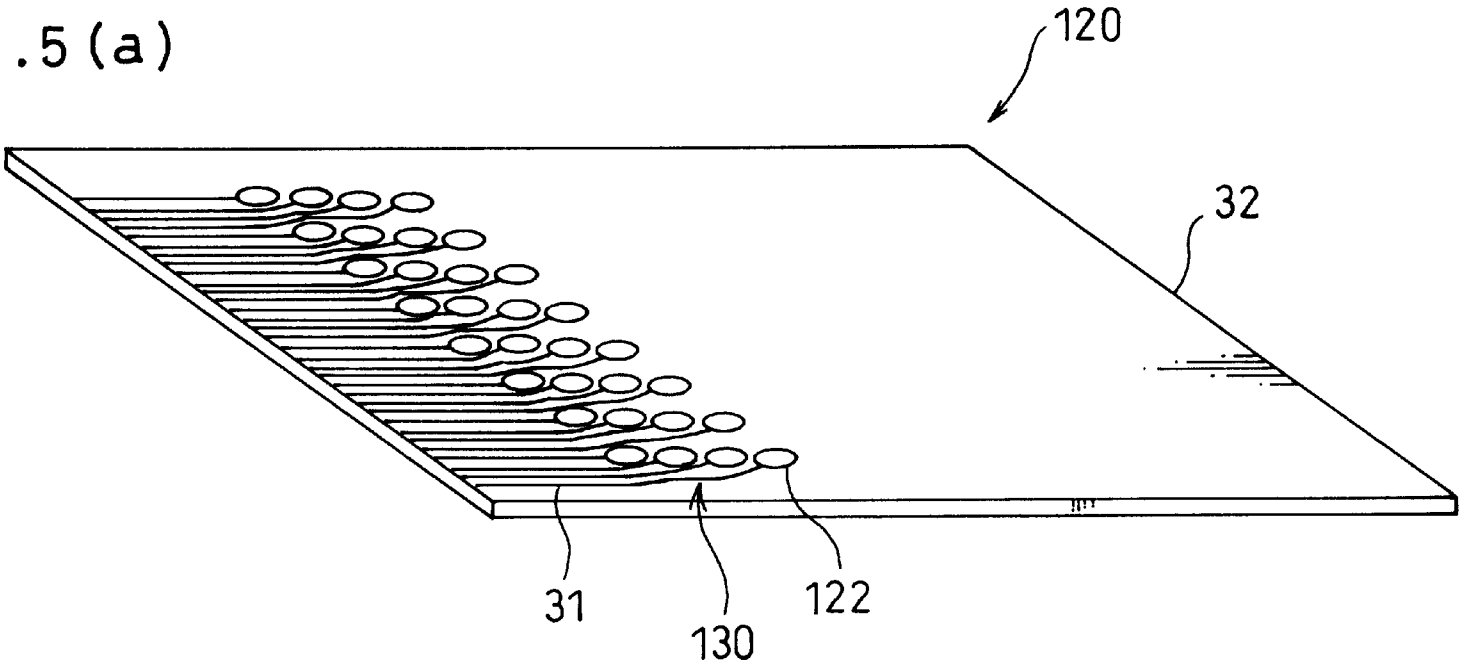
FIGS. 5(*a*) and 5(*b*) show another example of the head section of the control electrode, FIG. 5(*a*) being a perspective view and FIG. 5(*b*) being a cross section.
Figure 5B:
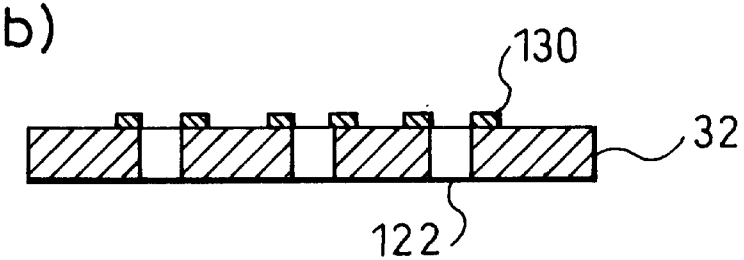
Figure 6:
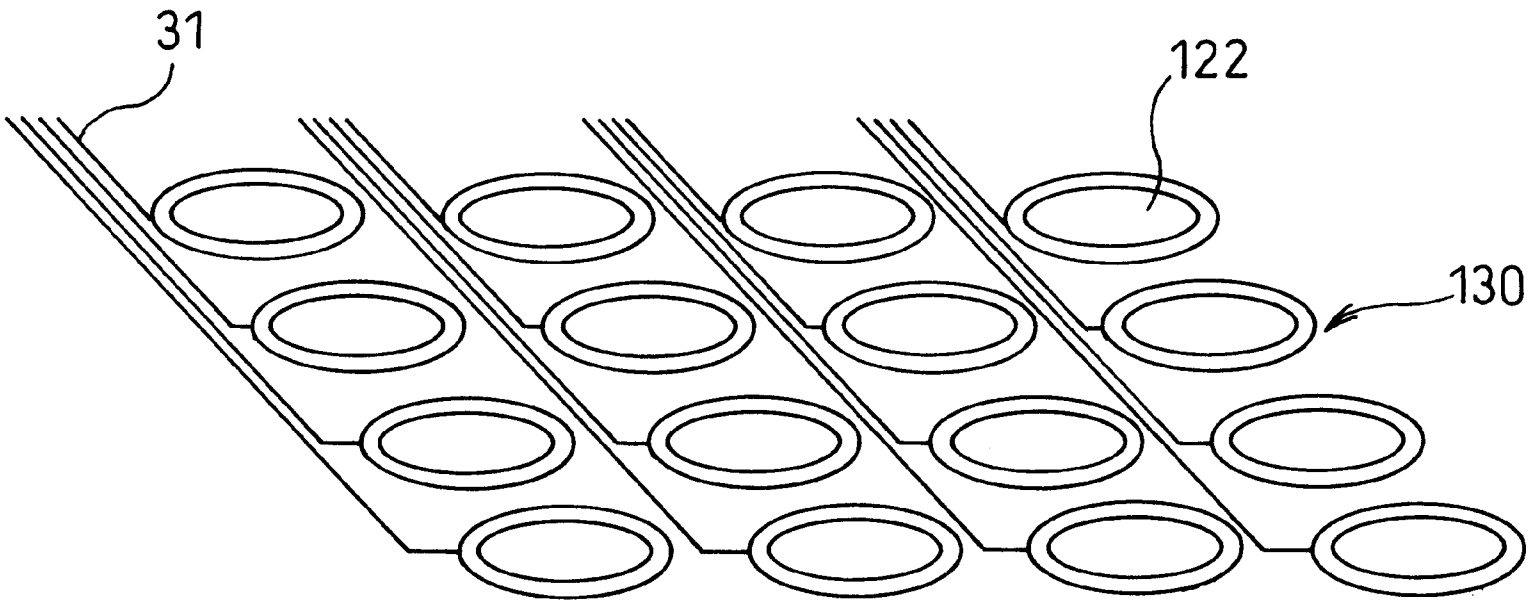
FIG. 6 is a perspective view showing a charged particle flow control grid of the head section shown in FIGS. 5(*a*) and 5(*b*).

The structure of the head section of the present invention is not necessarily limited to the head section 20. For example, it is possible to use a head section 120 shown in FIGS. 5(*a*) and 5(*b*) instead of the head section 20. In the head section 120, the insulator 32 has a plurality of circular apertures 122. As shown in FIG. 6, a charged particle flow control grid 130 is formed on one surface of the insulator 32. The charged particle flow control grid 130 has ring-shaped electrodes which are formed independently so as to enclose corresponding apertures 122, respectively.

Figure 7A:
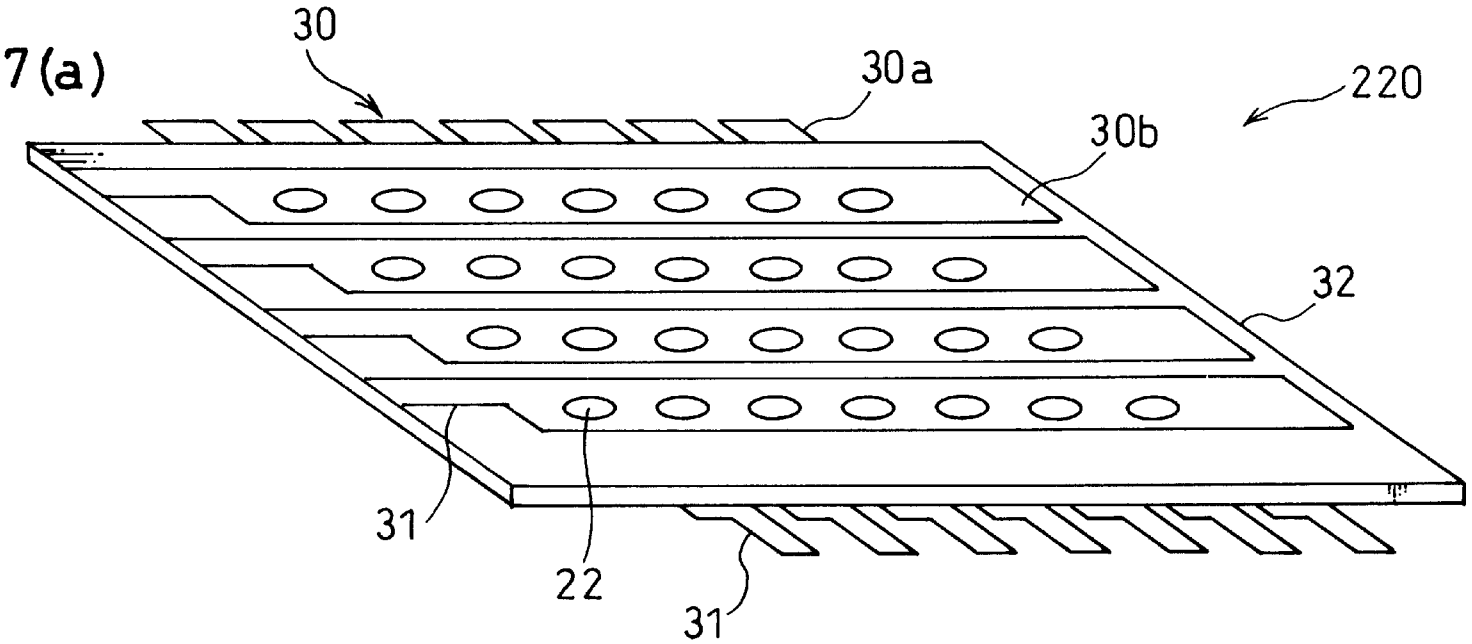
FIGS. 7(*a*) and 7(*b*) show still another example of the head section of the control electrode, FIG. 7(*a*) being a perspective view and FIG. 7(*b*) being a cross section.
Figure 7B:
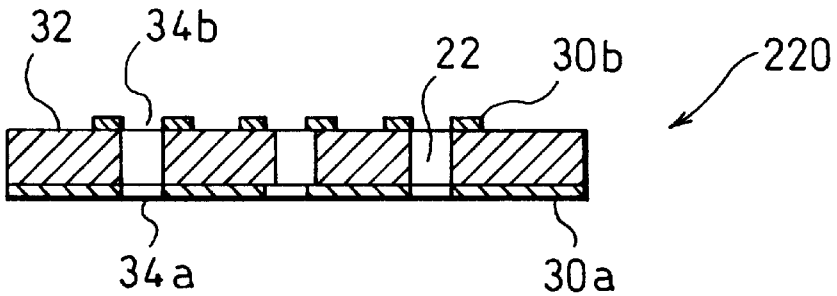
Figure 8:
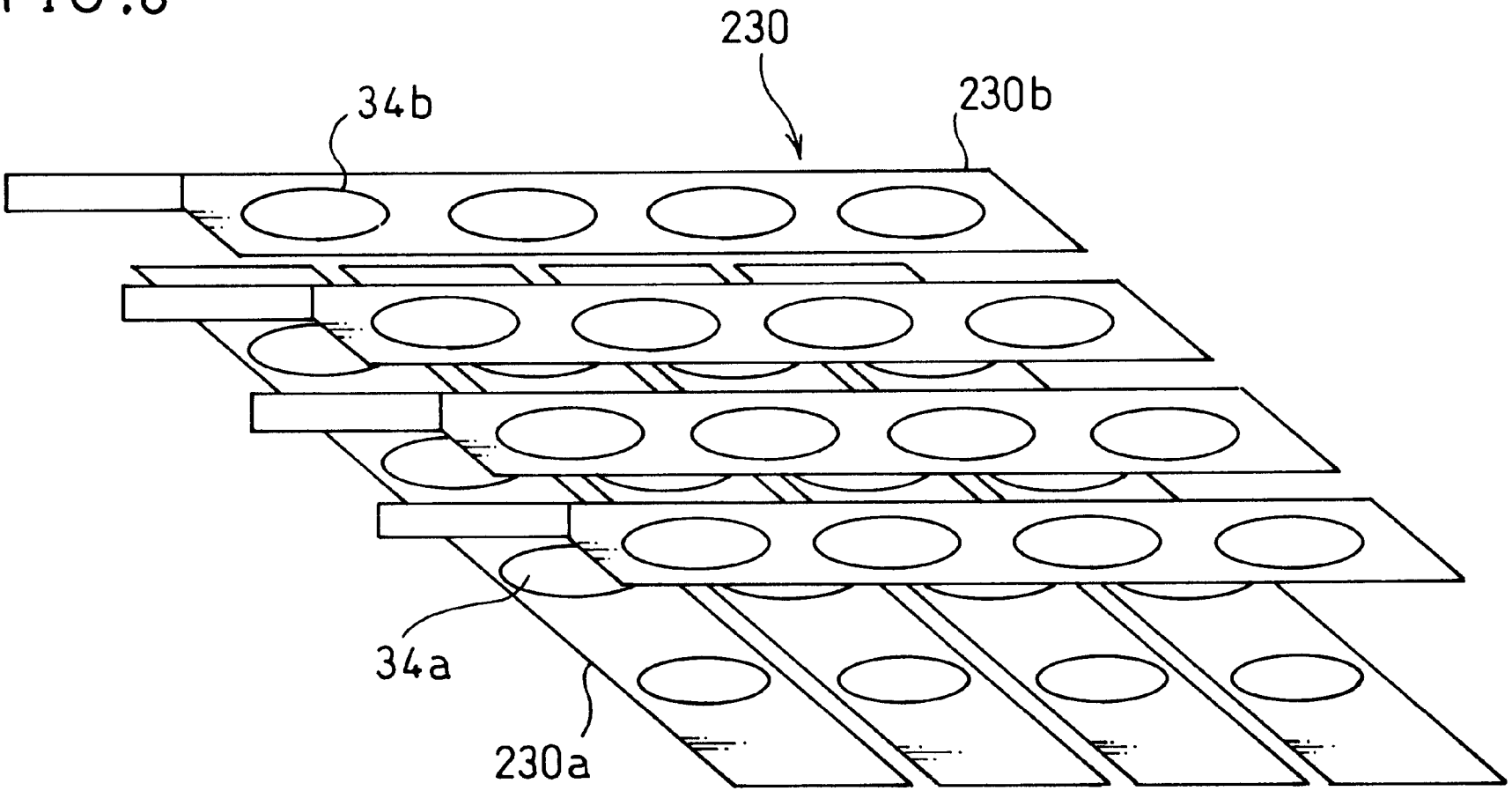
FIG. 8 is a perspective view showing a charged particle flow control grid of the head section shown in FIGS. 7(*a*) and 7(*b*).

It is also possible to use a head section 220 shown in FIGS. 7(*a*) and 7(*b*) instead of the head section 20. In the head section 220, like the head section 120, circular apertures 122 are formed in the insulator 32. As illustrated in FIG. 8, a charged particle flow control grid 230 is formed by placing flat X-direction electrodes 230*a* on the front face of the insulator 32 and flat Y-direction electrodes 230*b* on the back face of the insulator 32 so that the electrodes 230*a* and 230*b* cross each other at right angles. Holes 34*a* and holes 34*b* corresponding to the apertures 122 are formed in the electrodes 230*a* and electrodes 230*b*, respectively.

When forming an image by the recording head 9, a signal voltage corresponding to the image to be formed is intermittently applied to the control electrode 12 from the voltage applying section 17 so as to form a toner image on the recording medium 3. As a result, the electrostatic force acting in the vicinity of the control electrode 12 varies, and the control electrode 12 vibrates. When the vibration of the control electrode 12 derived from the application of the signal voltage and another vibration caused in the image forming apparatus (ambient vibration of the control electrode 12) produce resonance, noise occurs or the control electrode 12 is displaced. Consequently, the toner flying direction deviates from a target position.

In order to prevent resonance of the control electrode 12, in the image forming apparatus of the present invention, the frequency of vibration produced in the periphery of the control electrode 12 is arranged to differ from the control electrode 12. Namely, the driving frequency of a drive mechanism for driving a movable member, for example, the frequency of a voltage to be applied to a brushless motor such as a stepping motor for generating a driving force for rotating the transport roller, carrier 14, etc. for transporting the recording medium 3 and the frequency of mechanical vibration of a peripheral member of the control electrode 12 that is produced due to periodical torque variations of a driving force transmission system are arranged to differ from the resonant frequency (characteristic vibration frequency) of the control electrode 12.

Figure 20:
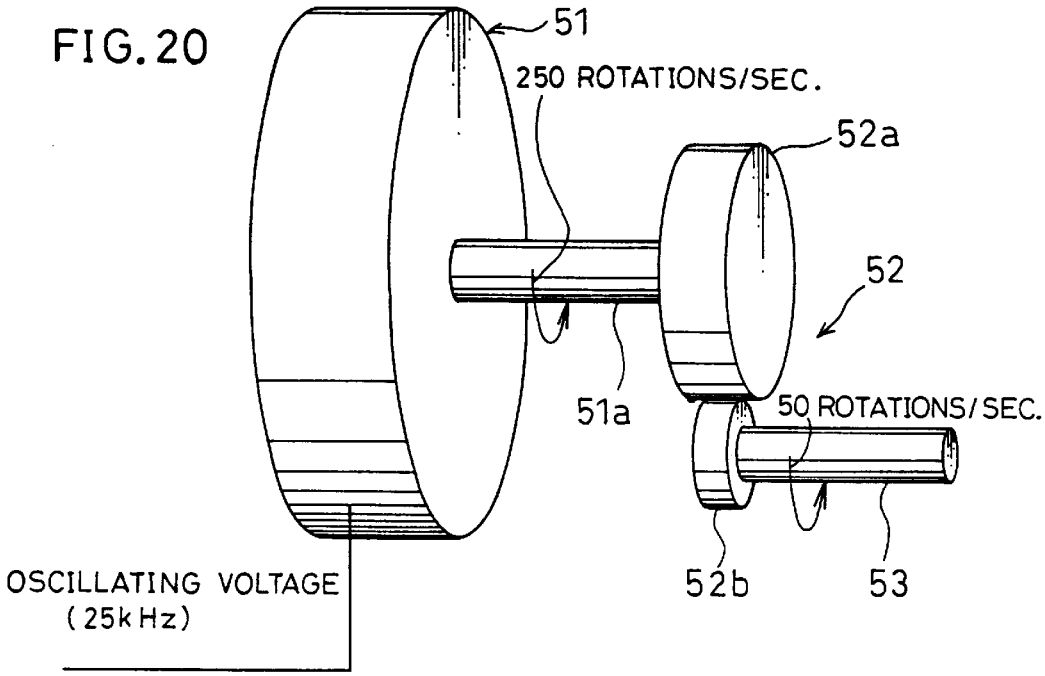
FIG. 20 is a perspective view showing an example a driving force transmission system.

More specifically, for example, as illustrated in FIG. 20, when a driving-use oscillating voltage of 25 kHz is applied to a 100-pole stepping motor 51, the rotor shaft 51*a* of the stepping motor 51 rotates 250 times per second in the direction shown by the arrow. At this time, there is a possibility that torque variations of 25 kHz and 250 kHz are caused in the rotor shaft 51*a* depending on the frequency of the oscillating voltage and the rotation speed of the rotor shaft 51*a*. Another possibility is that the stepping motor 51 itself vibrates at 25 kHz and 250 kHz.

Moreover, when a rotation shaft 53 of a movable roller (not shown, for example, a transport roller, carrier 14, etc. for transporting the recording medium 3) is connected to the rotor shaft 51*a* through a reduction gear 52 for reducing the angular velocity to a one fifth speed, the rotation shaft 53 of the movable roller rotates 50 times per second in the direction shown by arrow. Thus, there is a possibility that mechanical vibrations of 5 kHz and 50 Hz are produced in the driving force transmission system by the rotation of the rotation shaft 53 of the movable roller.

Furthermore, when the reduction gear 52 connected to the rotor shaft 51*a* is formed by a gear 52*a* with 200 teeth and a gear 52*b* with 40 teeth, there is a possibility that mechanical vibrations,occur at cycles corresponding to the pitches of the teeth of the gears 52*a* and 52*b*. Thus, there is a possibility that mechanical vibrations of 1 MHz, 200 kHz, 10 kHz, and 2 kHz occur in the driving force transmission system depending on the pitches of the teeth of the gears 52*a* and 52*b*.

Consequently, the frequencies of possible mechanical vibrations in the driving force transmission system are 1 MHz, 200 kHz, 25 kHz, 10 kHz, 5 kHz, 2 kHz, 250 Hz, and 50 Hz. However, in many cases, mechanical vibrations exceeding 10 kHz are not produced due to the influence of inertia.

When the characteristic vibration frequency of the control electrode 12 is 25 Hz, since the frequency twice that of the characteristic vibration frequency of the control electrode 12 coincides with one of the frequencies of mechanical vibrations caused in the driving force transmission system, the control electrode 12 produces resonance at 50 Hz.

In the case when the characteristic vibration frequency of the printing head section 20 is 10 kHz, it coincides with one of the frequencies, i.e., 10 kHz, of mechanical vibrations caused in the driving force transmission system. Thus, the printing head section 20 produces resonance at 10 kHz.

Therefore, in the image forming apparatus of the present invention, in order to prevent resonance of the control electrode 12 and printing head section 20, for example, a 110-pole motor is used as the stepping motor 51, and a driving voltage of 28 kHz is applied to the stepping motor 51. Consequently, the rotor shaft 51*a* rotates 254.54 times per second.

As a result, the frequencies of possible mechanical vibrations caused in the driving force transmission system are 1.12 MHz, 224 kHz, 28 kHz, 10.18 kHz, 5.6 kHz, 2.04 kHz, 254.54 Hz, and 50.91 Hz. Hence, the least common multiple of the frequency of mechanical vibration and the characteristic vibration frequency of the control electrode 12 or printing head section 20 is a very large value. Therefore, the control electrode 12 or printing head section 20 does not produce resonance with the mechanical vibration.

The present inventor worked out for the least common multiple so as to prevent vibrations produced by a movable member drive mechanism from vibrating the control electrode 12 and the component parts thereof. It was found that the control electrode 12 and the component parts thereof are not vibrated by the vibration of the movable member drive mechanism when minimum natural numbers m and n satisfying that m times the frequency of vibration of the movable member drive mechanism for driving the movable member of the image forming apparatus is equal to n times the characteristic vibration frequency of the control electrode 12 and the component parts thereof (for example, the printing head section 20) are more than 10.

Moreover, in order to prevent resonance of the control electrode 12 and the driving force transmission system, the least common multiple of the frequency of mechanical vibration of the driving force transmission system, and the characteristic vibration frequency of the control electrode 12 and the component parts thereof is increased. The least common multiple can be increased by changing the characteristic vibration frequency of the control electrode 12 and the component parts thereof as well as changing the structure of the drive mechanism for driving the movable member of the image forming as in the above-mentioned example. The characteristic vibration frequency of the control electrode 12 and the component parts thereof can be changed by changing the material, size, installation method, or position of the control electrode 12 and the component parts thereof.

Besides, the control electrode 12 and the component parts thereof are vibrated not only by the mechanical factors such as mechanical vibrations produced in the driving force transmission system, but also oscillations of a voltage applied to the control electrode 12.

Figure 21:
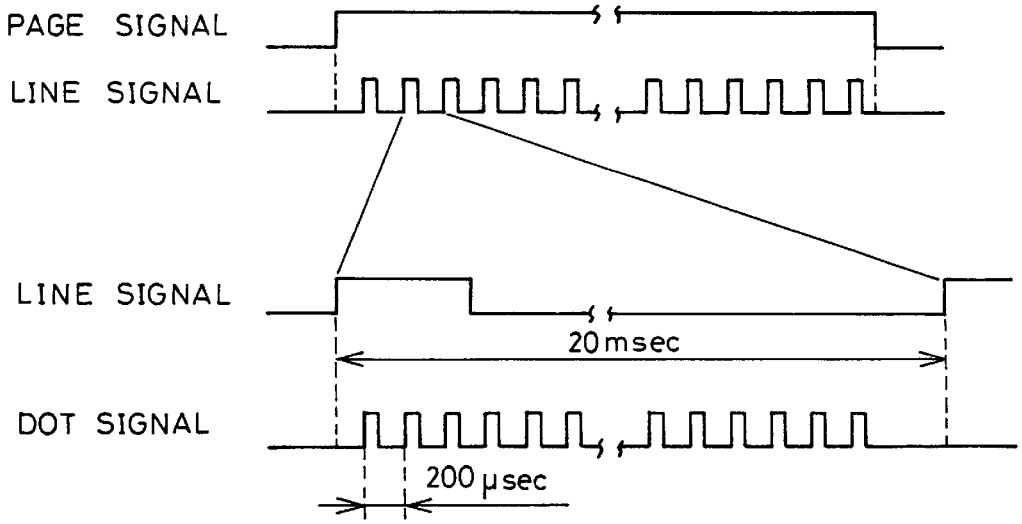
FIG. 21 is a waveform chart showing the waveforms of signals input to the control electrode.

As the signals for forming the toner image, a page signal as an oscillating voltage to be applied to the charged particle flow control grid 30 for forming an image of one page, a line signal as an oscillating voltage to be applied to the charged particle flow control grid 30 for forming one line by printing dots, and a dot signal as an oscillating voltage to be applied to the charged particle flow control grid 30 for forming one dot shown in FIG. 21 are input to the control electrode 12.

When the dot cycle as the period of the dot signal and the line cycle as the period of the line signal are 200 μsec, and 20 msec, respectively, the voltage application frequency of dot is 5 kHz and the voltage application frequency of line is 50 Hz.

At this time, if the characteristic vibration frequency of the control electrode 12 is 25 Hz, a frequency that is two times the characteristic vibration frequency of the control electrode 12 coincides with the voltage application frequency of line, and therefore, the control electrode 12 produces resonance at 50 kHz. Besides, if the characteristic vibration frequency of the printing head section 20 is 10 kHz, a frequency that is two times the voltage application frequency of dot coincides with the characteristic vibration frequency of the printing head section 20, and therefore the printing head section 20 produces resonance at 10 kHz.

Thus, in the image forming apparatus of the present invention, in order to prevent the control electrode 12 and the component parts thereof from being vibrated by the voltage applied to the control electrode 12, the least common multiple of the frequency of the voltage applied to the control electrode 12 and the characteristic vibration frequency of the control electrode 12 and component parts thereof is increased as in the case of preventing resonance due to mechanical vibrations. More specifically, the voltage applied to the control electrode 12 or the characteristic vibration frequency of the control electrode and component parts thereof is varied so as to increase the least common multiple.

Hence, in the image forming apparatus of the present invention, the resonance of the control electrode 12 is prevented by arranging the frequency of mechanical vibration produced in the driving force transmission system and the frequency of the voltage applied to the control electrode 12 to differ from the resonant frequency (characteristic vibration frequency) of the control electrode 12. This structure can suppress the generation of noise by the vibrations of the control electrode 12, thereby providing a quiet apparatus. Moreover, this structure can reduce the displacement of the control electrode 12 due to vibrations, thereby preventing deterioration of the image quality.

In this image forming apparatus, in theory, the distance between the carrier 14 and the head section 20 of the control electrode 12 needs to be a small value. It is therefore necessary to form the head section 20 with a small thickness. Thus, this structure produces deflective vibrations relatively easily.

On the other hand, the support section 21 for keeping the head section 20 in position is provided because the head section 20 cannot maintain its position by itself. Therefore, an elastic wave caused by deflective vibration tends to be reflected at the boundary between the thin head section 20 and the support section 21 thicker than the head section 20. As a result, the vibration is amplified by the reflection at the boundary, and a standing wave is produced on the head section 20. Consequently, even if the external vibration (ambient vibration) is weak, vibrations exist on the head section 20 for a long time.

Thus, it is preferable to change the structure of the control electrode 12 of the image forming apparatus so that the elastic wave produced in the control electrode 12 is scattered or absorbed. Consequently, the elastic wave is attenuated, thereby preventing generation of standing waves. It is therefore possible to prevent resonance of the control electrode 12.

A first means for preventing the generation of standing waves controls the reflection of elastic wave at the boundary surface between the rectangular head section 20 and the support section 21 so that the incident direction of the elastic wave differs from the reflecting direction with respect to the boundary surface.

Figure 9A:
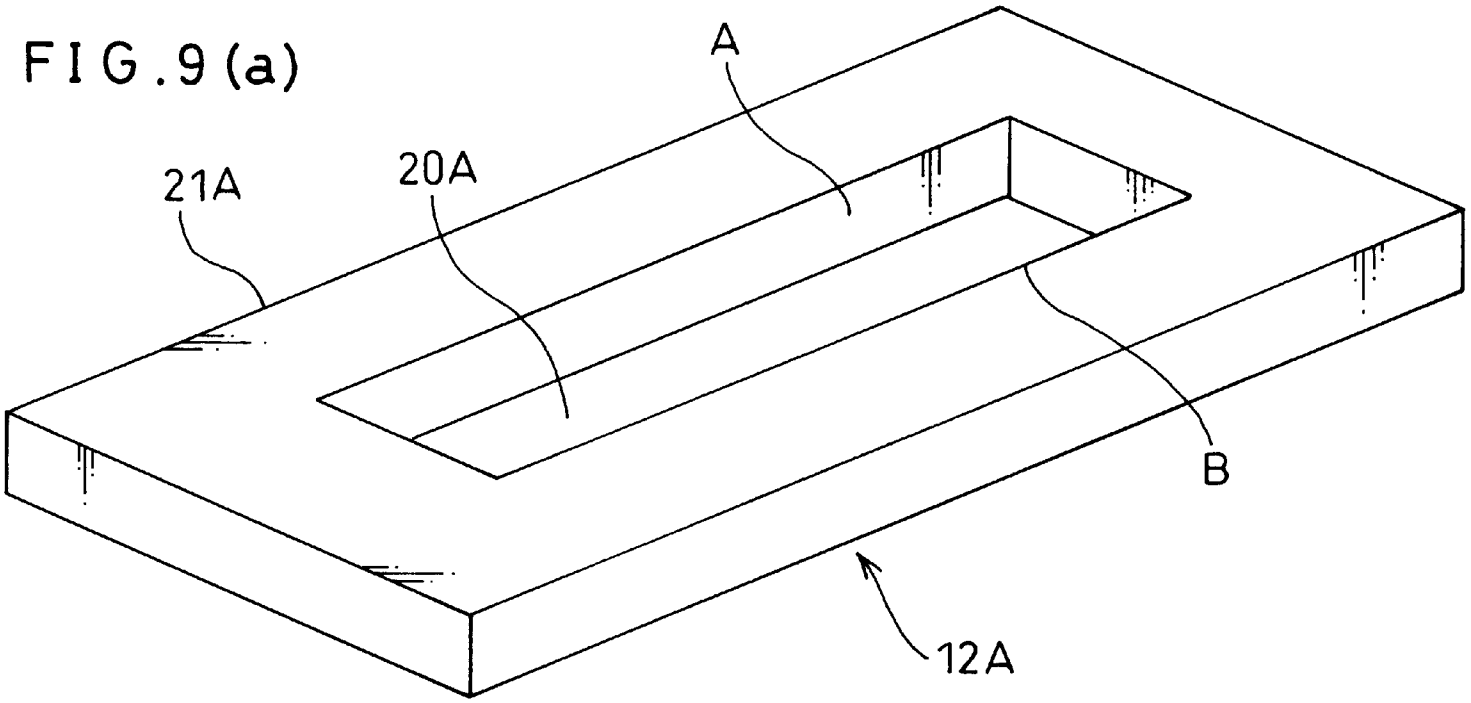
FIGS. 9(*a*) and 9(*b*) show an example of a control electrode having reflecting means, FIG. 9(*a*) being a perspective view and FIG. 9(*b*) being a cross section.
Figure 9B:
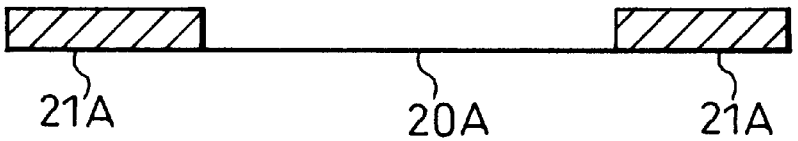

In order to achieve the first means, for example, as illustrated in FIG. 9(*a*), a control electrode 12A is provided instead of the control electrode 12. The control electrode 12A includes a head section 20A in the form of a flat plate and a support section 21A surrounding the head section 20A. The head section 20A and support section 21A are disposed so that an extended plane from a boundary plane A that is one of the boundary surfaces between the head section 20A and support section 21A crosses an extended plane from a boundary plane B that faces the boundary plane A, i.e., the boundary planes A and B are not parallel to each other. In the control electrode 12A, the periphery of the head section 20A is arranged so that length a of a side is not equal to length b of other side.

In this structure, when an elastic wave transmitted along the head section 20A is reflected by the boundary surface between the head section 20A and the support section 21A, the incident direction of the elastic wave and the reflected direction deviate from each other. Consequently, the deflective vibration is not amplified by the reflection at the boundary surface, and the generation of standing waves is suppressed. It is thus possible to scatter the elastic wave, and prevent resonance of the control electrode 12A.

Figure 10:
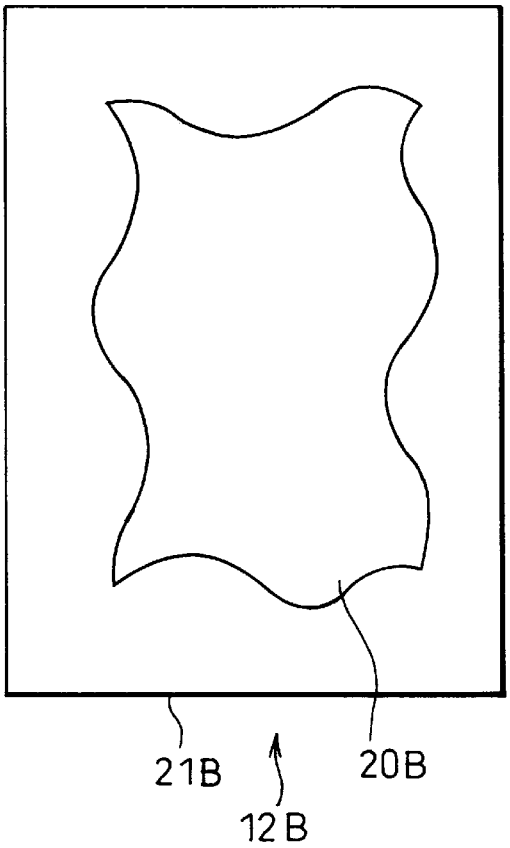
FIGS. 10(*a*) and 10(*b*) are plan views showing another example of the control electrode having reflecting means.
Figure 10:
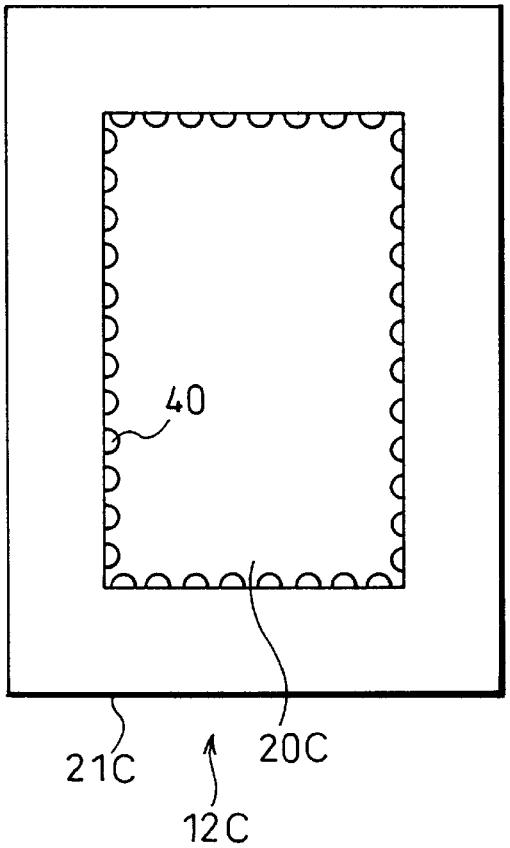

A second means for preventing generation of standing waves includes a control electrode 12B as shown in FIG. 10(*a*), instead of the control electrode 12. The control electrode 12B has a support section 21B and a head section 20B. The support section 21B and head section 20B are disposed so that the boundary surfaces between the support section 21B and head section 20B are curved surfaces and are not parallel to each other.

It is also possible to provide a control electrode 12C as shown in FIG. 10(*b*), instead of the control electrode 12. The control electrode 12C is produced by forming minute protruding sections 40 on the boundary surface between the rectangular support section 21C and the head section 20C so as to diffuse the elastic wave. The protruding sections 40 are formed by the same material as the head section 20C.

Moreover, the shape of the head section 20C of the control electrode 12 may be changed from rectangle to a polygon having no parallel boundary planes, for example, a regular pentagon.

The second means for preventing the generation of standing waves is a vibration changing member that is mounted on the control electrode 12 to change the vibration of the control electrode 12. Here, changing the vibration means damping or diffusion of vibration.

Figure 11:
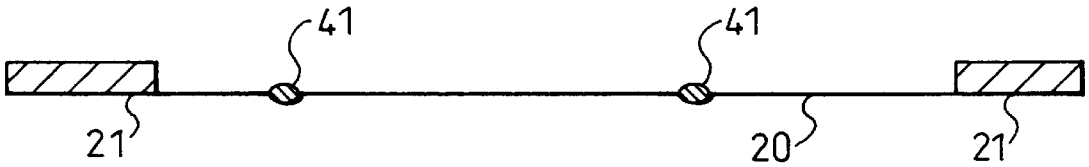
FIG. 11 is a cross section of a control electrode having a vibration diffuser.
Figure 12:
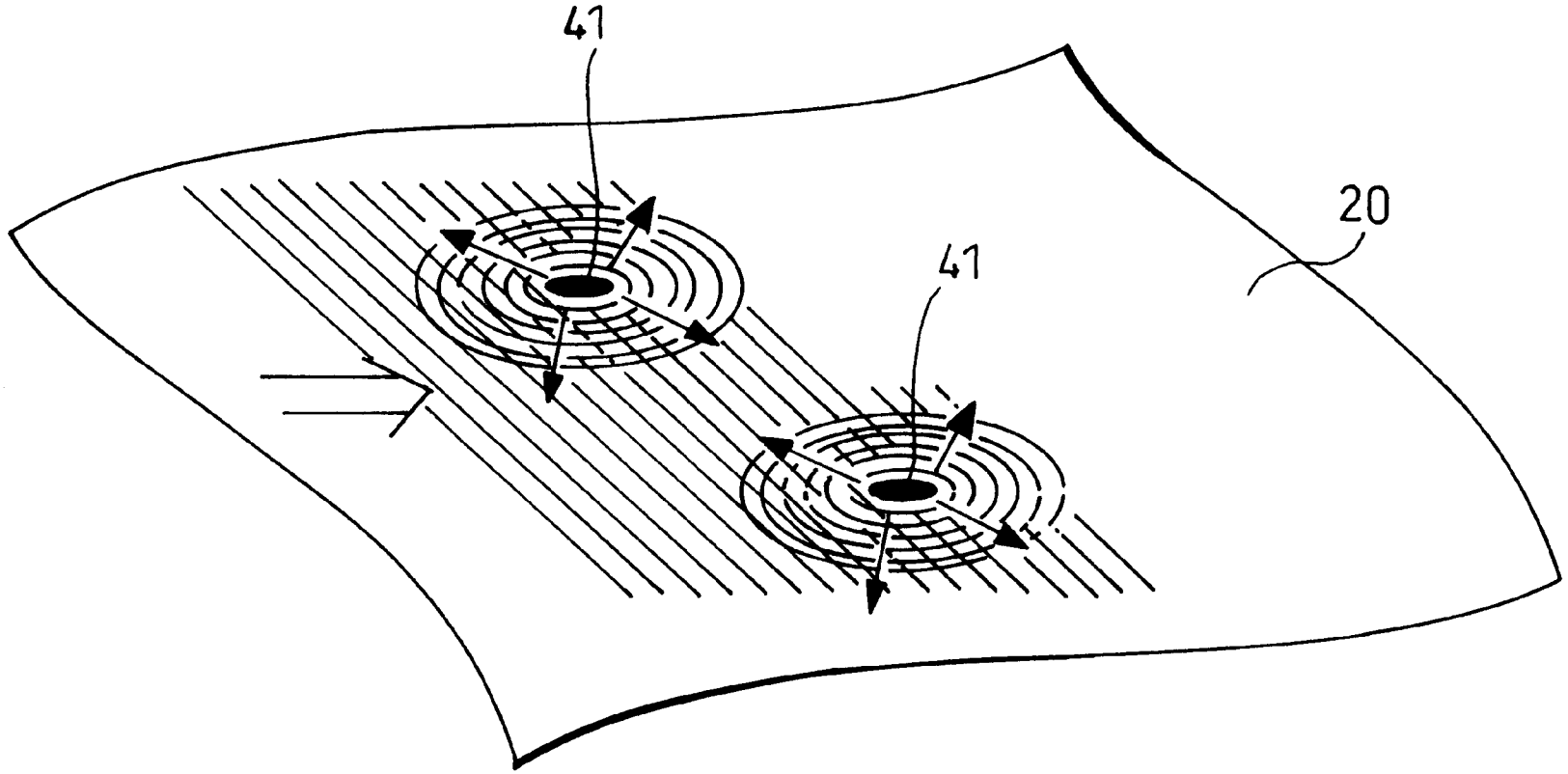
FIG. 12 is an explanatory view showing how a vibration is diffused.

For example, as illustrated in FIG. 11, the vibration changing member is formed by a vibration diffuser 41 mounted on the head section 20. The vibration diffuser 41 can be a substance that is different from the insulator 32 and mounted on the insulator 32, a protruding section that is formed by partially increasing the thickness of the insulator 32, or a recessed section (or a raised section) that is produced by folding the insulator 32 or patterning the insulator 32 with protrusions and recessions. The vibration diffuser 41 is arranged to form a pattern of scattered dots on the head section 20, except for the regions of the apertures 22 and the charged particle flow control grid 30.Then, Then, as shown in FIG. 12, when the elastic wave of deflective vibration to-be transmitted in a single direction through the head section 20 is incident on the vibration diffuser 41, the elastic wave is scattered in a plurality of directions by the vibration diffuser 41. This structure enables diffusion of the elastic wave of deflective vibration, thereby suppressing the generation of standing waves. Namely, by providing the vibration diffuser 41, it is possible to prevent resonance of the control electrode 12, and provide the control electrode 12 with a structure which is hard to be vibrated.

Moreover, a vibration absorbing diffuser with Young's modulus different from that of the head section 20 can be mounted as another movable member on the head section 20. As the vibration absorbing diffuser, it is possible to use the one having Young's modulus different from the head section 20 in appearance. For example, the vibration absorbing diffuser can be formed by fitting or burying a different insulating substance into a part of the insulator 32. It is also possible to use the protruding section formed by partially varying the thickness of the charged particle flow control grid 30 as the vibration changing member. An enhanced effect is produced by placing the vibration absorbing diffuser linearly in a direction orthogonal to the traveling direction of the elastic wave of vibration. Furthermore, the vibration diffuser 41 performs a function similar to the vibration absorbing diffuser.

Figure 13A:
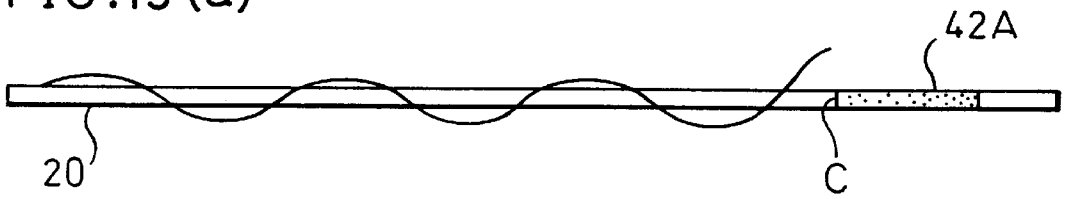
FIGS. 13(*a*) and 13(*b*) are explanatory view showing the theory of a vibration absorbing diffuser, and more specifically FIG. 13(*a*) is a cross section of a vibration absorbing diffuser with Young's modulus lower than that of the head section and FIG. 13(*b*) is a cross section of a vibration absorbing diffuser with Young's modulus higher than that of the head section.
Figure 13B:
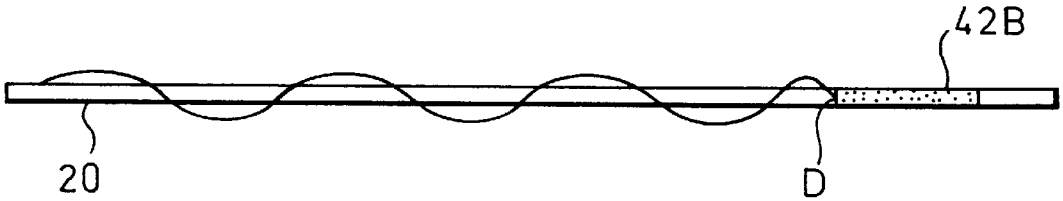

As illustrated in FIG. 13(*a*), when the vibration absorbing diffuser is a vibration absorbing diffuser 42A with Young's modulus lower than that of the head section 20, the elastic wave propagated along the head section 20 is reflected at a boundary surface C between the head section 20 and the vibration absorbing diffuser 42A so that the reflection at the boundary surface C is between reflection at a free end and reflection at a fixed end but is closer to the reflection at the free end. Consequently, in the vibration absorbing diffuser 42A, the elastic wave is absorbed and scattered in a plurality of directions by reflecting a part of the elastic wave and transmitting a part of the elastic wave.

As shown in FIG. 13(*b*), in the case when the vibration absorbing diffuser is a vibration absorbing diffuser 42B with Young's modulus higher than that of the head section 20, the elastic wave propagated along the head section 20 is reflected at a boundary surface D between the head section 20 and vibration absorbing diffuser 42B so that the reflection at the boundary surface D is between reflection at a free end and reflection at a fixed end but is closer to the reflection at the fixed end. Thus, in the vibration absorbing diffuser 42B, the elastic wave is mainly reflected, and scattered in a plurality of directions.

As described above, by providing the vibration absorbing diffuser 42A or 42B, the elastic wave is reflected at the boundary surface between the head section 20 and the vibration absorbing diffuser 42A or 42B so that reflection at the boundary surface is between reflection at the fixed end and reflection at the free end. Therefore, the elastic wave of deflective vibration incident on the boundary surface is scattered in a plurality of directions because a part of the elastic wave is reflected and the remaining part is transmitted. As a result, the elastic wave caused by deflective vibration is diffused, thereby suppressing the generation of standing waves.

Figure 14:
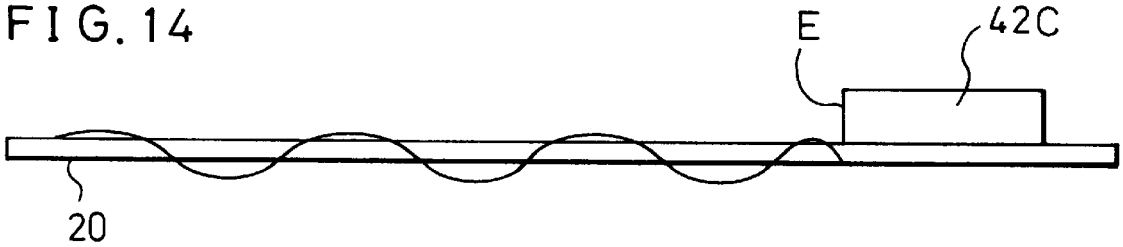
FIG. 14 is a cross section showing a vibration absorbing diffuser formed by varying a thickness of a head section.

Supposing that the vibration absorbing diffuser is a vibration absorbing diffuser 42C which is formed by partially increasing the thickness of the insulator 32 of the head section 20 so as to protrude from the head section 20 as shown in FIG. 14. In this case, the transmission impedance of elastic wave varies at the vibration absorbing diffuser 42C, and a part of the elastic wave is transmitted and the remaining part thereof reflected at a boundary surface E where the thickness of the head section 20 changes. With this structure, the elastic wave caused by the deflective vibration can be scattered, thereby suppressing the generation of standing waves. Moreover, by simply increasing the thickness of the insulator 32 of the head section 20 partially, a part of the insulator 32 with an increased thickness (i.e., the vibration absorbing diffuser 42C) can perform the function of absorbing and scattering vibrations. Since this function is achieved without using a substance different from the insulator 32, it is possible to minimize the increase in the cost.

Figure 15:
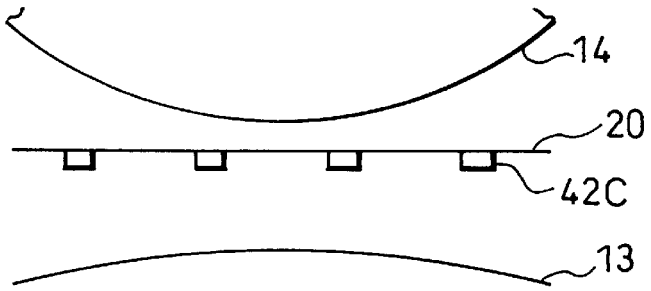
FIG. 15 is a cross section showing the position of the vibration absorbing diffuser.

Additionally, since the space between the head section 20 of the control electrode 12 and the developer tank 11 is very small, it is preferred to mount the vibration absorbing diffuser 42A to 42C or vibration diffuser 41 on a surface of the head section 20, which faces the back electrode 13. FIG. 15 illustrates an example in which a plurality of the vibration absorbing diffusers 42C are mounted on the surface of the head section 20, which faces the back electrode 13. This structure can surely prevent the vibration absorbing diffuser 42A to 42C or vibration diffuser 41 from coming into contact with the toner layer on the carrier 14. As a result, the vibration can be diffused and absorbed without producing bad effects on the toner layer, thereby providing the control electrode 12 that is hard to be vibrated.

As the second means for eliminating standing waves, a damping member for damping vibrations is provided at the boundary section (junction) between the head section 20 and support section 21. Here, in order to damp vibrations, the reflection coefficient of the elastic wave at the boundary section needs to be between a reflection coefficient at the free end and a reflection coefficient at the fixed end.

Figure 16:
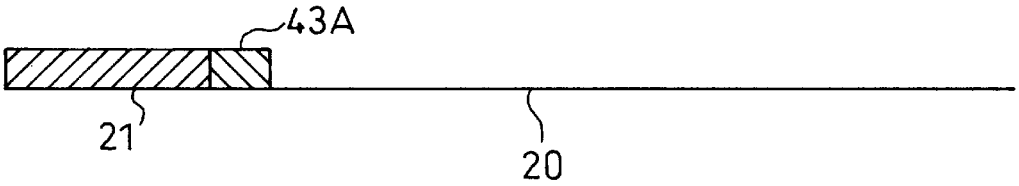
FIG. 16 is a cross section showing a control electrode having a damper.

As illustrated in FIG. 16, a damper 43A is provided as the damping member at the boundary section between the head section 20 and support section 21. As the damper 43A, an elastic body softer than the support section 21, for example, urethane rubber, silicone rubber, elastomer, etc. is used. One end of the damper 43A is fixed to the support section 21, while the other end is fixed to the head section 20.

With this structure, the reflection coefficient of the elastic wave at the boundary section between the head section 20 and damper 43A is between the reflection coefficient at the free end and the reflection coefficient at the fixed end. Therefore, when transmitting the elastic wave to the support section 21 through the damper 43A, a part of the elastic wave travelling through the head section 20 is reflected at the boundary between the head section 20 and damper 43A, and the remaining part thereof is transmitted. Moreover, since the damper 43A is made of the elastic body, the energy of the elastic wave is consumed within the damper 43A. Similarly to the above, a part of the elastic wave is reflected at the boundary between the support section 21 and damper 43A, and the remaining part thereof is transmitted. In this process, the elastic wave on the head section 20 is gradually attenuated between the head section 20 and support section 21. As a result, the elastic wave is attenuated, and the generation of standing waves is suppressed.

By the way, since the Young's modulus of the damper 43A made of a uniform component is uniform, the reflection coefficient of the elastic wave at the boundary between the head section 20 and support section 21 is uniform. Therefore, a part of the elastic wave is reflected at the boundary, and standing waves may be generated on the control electrode 12.

Figure 17:
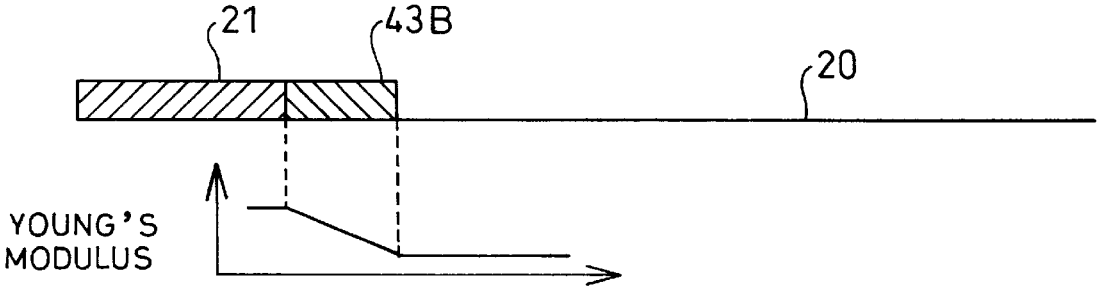
FIG. 17 is a cross section showing a control electrode having a damper with varying Young's modulus.

In order to prevent such reflection, it is preferred to use a damper 43B as shown in FIG. 17, instead of the damper 43A. The Young's modulus of the damper 43B varies from the support section 21 toward the head section 20.

For example, the Young's modulus of urethane rubber can be varied within a range of from 70 to 700 kg/mm$^2$ by changing the internal composition of the urethane rubber. Thus, by forming the damper 43B from urethane rubber whose internal composition is gradually changed, it is possible to produce the damper 43B by using one kind of substance whose Young's modulus lowers gradually from the support section 21 toward the head section 20.

Figure 18:
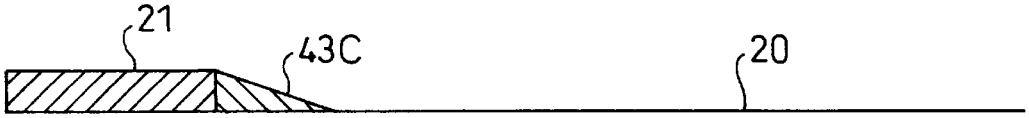
FIG. 18 is a cross section showing a control electrode having a damper with varying thickness.

It is also possible to use a damper 43C as shown in FIG. 18, instead of the damper 43B. The thickness of the damper 43C is gradually reduced from the support section 21 toward the head section 20. Therefore, it is possible to provide the damper 43C with Young's modulus that is seemingly lowered gradually from the support section 21 toward the head section 20 without causing an increase in the cost.

Moreover, it is possible to use a damper formed by layering a plurality of substances with different Young's modulus as a single part, instead of the damper 43A to 43C. In this case, the Young's modulus varies step by step. Furthermore, it is possible to use a damper with Young's modulus that becomes highest at the center thereof and decreases gradually toward the both ends thereof.

As described above, by arranging the dampers 43B and 43C so that the reflection coefficient of the elastic wave varies continuously, it is possible to provide dampers 43B and 43C having no reflection boundary therein with respect to the propagation of elastic wave. In this structure, the reflection coefficient of the elastic wave at the dampers 43B and 43C continuously varies from the reflection coefficient at the free end (i.e., −1) to the reflection coefficient at the fixed end (i.e., 1). Therefore, when transmitting the elastic wave that has travelled through the head section 20 to the support section 21 through the dampers 43B and 43C, the elastic wave is gradually damped while repeating the reflection of a part of the elastic wave and transmission of the remaining part of the elastic wave. In this process, the elastic wave on the head section 20 is damped between the head section 20 and support section 21. It is thus possible to prevent the reflection of elastic wave, and suppress the generation of standing waves.

Figure 19:
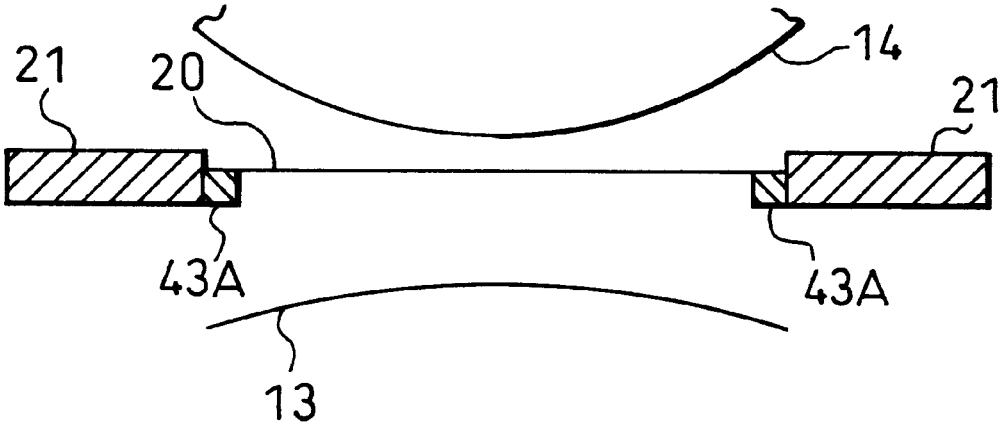
FIG. 19 is a cross section showing the position of the damper.

Each of the dampers 43A to 43C is disposed on a surface of the control electrode 12, which faces the back electrode 13, so that the dampers 43A to 43C do not come into contact with the toner layer on the carrier 14. FIG. 19 shows an example in which the damper 43A is placed on the surface of the control electrode 12, which faces the back electrode 13. This structure can damp vibrations without causing vicious effects on the toner layer.

Needless to say, the present invention is not necessarily limited to the above-mentioned embodiment, and alternatives, modifications and equivalents may be included within the scope of the invention. For example, it is possible to use any suitable combination of a vibration absorbing diffuser, a vibration diffuser, and a damper. Moreover, it is possible to combine such members with means for controlling reflection. Furthermore, it is possible to use means for shifting the resonant frequency of the control electrode 12 with a combination of these members.

As explained above, according to the present invention, it is possible to prevent the control electrode 12 from producing resonance during image formation by shifting the frequency of a voltage applied to the control electrode 12 from the resonant frequency (characteristic vibration frequency) of the control electrode 12. This structure can prevent generation of noise due to vibrations of the control electrode 12, thereby providing a quiet image forming apparatus. Additionally, since the displacement of the control electrode 12 is suppressed, it is possible to improve the image quality.

Moreover, according to the present invention, reflection is controlled so that the incident direction of the elastic wave on the boundary surface between the head section 20 of the control electrode 12 and the support section 21 for supporting the periphery of the head section 20 differs from the reflecting direction. With this control, since the standing wave is scattered, the control electrode 12 has a structure capable of suppressing the generation of standing waves. It is thus possible to provide a quiet image forming apparatus by preventing the generation of noise due to vibrations of the control electrode 12, suppress the displacement of the control electrode 12, and improve the image quality.

Furthermore, according to the present invention, the control electrode 12 is provided with the vibration changing member for changing vibrations (for example, the vibration absorbing diffusers 42A to 42C, or vibration diffuser 41). This structure can diffuse and damp the vibration of the control electrode 12, thereby suppressing the generation of standing waves. Consequently, since the generation of noise due to the vibrations of the control electrode 12 is prevented, it is possible to provide a quiet image forming apparatus. Additionally, since the displacement of the control electrode 12 is suppressed, it is possible to improve the image quality.

In addition, according to the present invention, the damping member (for example, dampers 43A to 43C) for damping vibrations is provided at the boundary between the head section 20 and support section 21. This structure can attenuate the elastic wave on the control electrode 12 by the damping member, thereby suppressing the generation of standing waves in the control electrode 12. Consequently, it is possible to form an image with improved image quality quietly by preventing the generation of noise due to the vibrations of the control electrode 12 and suppressing the displacement of the control electrode 12.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

a carrier for carrying toner;

a back electrode disposed with a space between said carrier and said back electrode;

a control electrode, disposed between said carrier and said back electrode, for forming an electric field capable of causing toner on said carrier to fly toward said back electrode from said carrier, and forming an image by causing selectively the toner to fly and adhere to a recording medium passing between said control electrode and said back electrode, according to an image signal; and voltage applying means for applying an oscillating voltage to said control electrode, wherein a frequency of the oscillating voltage to be applied to said control electrode is set so as to prevent resonance of said control electrode.

2. The image forming apparatus as set forth in claim 1, wherein minimum natural numbers m and n satisfying that m times a frequency of an oscillating voltage to be applied to said control electrode for forming one dot in forming an image is equal to n times a characteristic vibration frequency of said control electrode are more than 10.

3. The image forming apparatus set forth in claim 1, wherein minimum natural numbers m and n satisfying that m times a frequency of an oscillating voltage to be applied to said control electrode for forming one line by a plurality of dots in forming an image is equal to n times a characteristic vibration frequency of said control electrode are more than 10.

4. An image forming apparatus comprising:

a carrier for carrying toner;

a back electrode disposed with a space between said carrier and said back electrode;

a control electrode, disposed between said carrier and said back electrode, for forming an electric field capable of causing toner on said carrier to fly toward said back electrode from said carrier, and forming an image by causing selectively the toner to fly and adhere to a recording medium passing between said control electrode and said back electrode, according to an image signal;

a movable member drive mechanism for driving a movable member;

wherein a frequency of a vibration produced by a driving operation of said movable member drive mechanism is set so as to prevent resonance of said control electrode; and wherein minimum natural numbers m and n satisfying that m times the frequency of the vibration produced by a driving operation of said movable member drive mechanism is equal to n times a characteristic vibration frequency of said control electrode are more than 10.

5. An image forming apparatus comprising:

a carrier for carrying toner;

a back electrode disposed with a space between said carrier and said back electrode;

a control electrode, disposed between said carrier and said back electrode, for forming an electric field capable of causing toner on said carrier to fly toward said back electrode from said carrier, and forming an image by causing selectively the toner to fly and adhere to a recording medium passing between said control electrode and said back electrode, according to an image signal, said control electrode including a head section to which a voltage is applied according to the image signal, and a support section for supporting said head section in a main body of said image forming apparatus;

a boundary surface between said head section and said support section, said boundary surface reflecting an elastic wave incident on said boundary surface in a direction different from an incident direction so as to prevent generation of a standing wave in said control electric;

wherein the support section is in the form of a flat plate having an opening, said support section supporting the head section where the opening is provided; and wherein the opening is in the form of a polygon, and at least one side of the polygon and its opposite side cross each other on their extensions.

6. An image forming apparatus comprising:

a carrier for carrying toner;

a back electrode disposed with a space between said carrier and said back electrode;

a control electrode, disposed between said carrier and said back electrode, for forming an electric field capable of causing toner on said carrier to fly toward said back electrode from said carrier, and forming an image by causing selectively the toner to fly and adhere to a recording medium passing between said control electrode and said back electrode, according to an image signal, said control electrode including a head section to which a voltage is applied according to the image signal, and a support section for supporting said head section in a main body of said image forming apparatus;

a damping member, disposed in a boundary section between said head section and said support section, for damping a vibration of said control electrode so as to prevent generation of a standing wave in said control electrode; and wherein said damping member is a damper with a thickness varying from said support section toward said head section.

7. The image forming apparatus as set forth in claim 6, wherein said damping member is disposed on a surface of said control electrode, said surface facing said back electrode.

8. An image forming apparatus comprising:

a carrier for carrying toner;

a back electrode disposed with a space between said carrier and said back electrode;

a control electrode, disposed between said carrier and said back electrode, for forming an electric field capable of causing toner on said carrier to fly toward said back electrode from said carrier, and forming an image by causing selectively the toner to fly and adhere to a recording medium passing between said control electrode and said back electrode, according to an image signal, said control electrode including a head section to which a voltage is applied according to the image signal, and a support section for supporting said head section in a main body of said image forming apparatus;

a boundary surface between said head section and said support section, said boundary surface reflecting an elastic wave incident on said boundary surface in a direction different from an incident direction so as to prevent generation of a standing wave in said control electrode;

wherein the support section is in the form of a flat plate having an opening, and the support section supports the head section where the opening is provided; and wherein inner surfaces of the support section are curved.

9. The image forming apparatus as set forth in claim 8, wherein the inner surfaces of the support section include a flat portion and a protruding curved portion.

* * * * *